United States Patent [19]

Stockinger et al.

[11] Patent Number: 4,881,598

[45] Date of Patent: Nov. 21, 1989

[54] BLOW-OUT PREVENTOR TEST TOOL

[75] Inventors: Michael P. Stockinger, Missouri City, Tex.; James R. Tietema, Gretna; Lee S. Bass, New Iberia, both of La.

[73] Assignee: Conoco Inc., Ponca City, Okla.

[21] Appl. No.: 266,971

[22] Filed: Nov. 3, 1988

[51] Int. Cl.[4] ..... E21B 41/00; E21B 47/00; G01M 3/08

[52] U.S. Cl. ..... 166/250; 166/80; 166/336; 166/337; 73/40.5 R; 73/46; 73/49.1; 73/151

[58] Field of Search ..... 166/80, 82, 85, 250, 166/336, 337; 175/40; 73/40.5 R, 49.1, 49.6, 49.8, 46, 151; 285/333, 298

[56] References Cited

U.S. PATENT DOCUMENTS

| | | | |
|---|---|---|---|
| 2,951,363 | 9/1960 | Diodene | 73/40.5 R |
| 3,093,996 | 6/1963 | Jones | 73/40.5 R |
| 3,177,703 | 4/1965 | Waters et al. | 73/40.5 |
| 3,872,713 | 3/1975 | Ilfrey et al. | 73/40.5 R |
| 3,897,824 | 8/1975 | Fisher | 166/188 |
| 4,018,276 | 4/1977 | Bode | 166/183 |
| 4,030,354 | 6/1977 | Scott | 73/151 |
| 4,090,395 | 5/1978 | Dixon et al. | 73/40.5 R |
| 4,152,924 | 5/1979 | Mayo | 73/40.5 R |
| 4,159,637 | 7/1979 | Lamb et al. | 73/46 |
| 4,306,447 | 12/1981 | Frans, Jr. | 73/46 |
| 4,347,733 | 9/1982 | Crain | 73/40.5 R |
| 4,383,436 | 5/1983 | Hailey | 73/46 |
| 4,554,976 | 11/1985 | Hynes et al. | 166/341 |
| 4,559,809 | 12/1985 | Mayo | 73/40.5 R |

OTHER PUBLICATIONS 1982-83 Composite Catalog of Oilfield Equipment and Services, vol. 2, p. 1949.

1982-83 Composite Catalog of Oilfield Equipment and Services, vol. 2, p. 1618.

*Primary Examiner*—Bruce M. Kisliuk

[57] ABSTRACT

Apparatus and methods are provided for testing a blow-out preventor system of a well, which blow-out preventor system is designed to close upon both a smaller drill pipe string and a larger drill pipe string. The apparatus includes a first elongated cylindrical testing mandrel having an outside diameter substantially equal to an outside diameter of the smaller drill pipe string, and a second elongated cylindrical testing mandrel having an outside diameter substantially equal to an outside diameter of the larger drill pipe string. The first testing mandrel is telescopingly received within the second testing mandrel. A releasable locking structure is provided for releasably locking the testing mandrels in a telescopingly extended position whereby the blow-out preventor system can be tested against the first testing mandrel, and for releasing the tested mandrels from their telescopingly extended position so that they move to a telescopingly collapsed position whereby the blow-out preventor system can also be tested against the second testing mandrel without tripping the testing apparatus out of the well in which the blow-out preventor system is installed.

24 Claims, 5 Drawing Sheets

BLOW-OUT PREVENTOR TEST TOOL

BACKGROUND OF THE INVENTION

1. Field of the Invention

The present invention relates generally to testing tools for testing blow-out preventors of a well, and more particularly, but not by way of limitation, to a testing tool for testing blow-out preventors of a subsea well.

2. Description of the Prior Art

Oil and gas wells typically have a blow-out preventor system located on top of the wellhead of the well. This blow-out preventor system will include several individual blow-out preventors of various types which are capable of closing in the well in the event excessive pressures are encountered downhole.

Particularly, when drilling a subsea well, governmental regulations generally require relatively frequent, e.g., weekly, testing of the blow-out preventors. The blow-out preventors of a subsea well are typically located at the ocean floor and thus may be several thousand feet below the drilling platform.

Also, in such subsea wells it is very typical that a tapered drill string is being used. The term tapered drill string refers to a system which utilizes a larger diameter drill string for drilling an initial portion of the well, and a smaller diameter drill string for drilling a lower portion of the well. For example, a typical tapered drill string might involve the use of both 5-inch outside diameter drill pipe and 3½-inch outside diameter drill pipe.

The blow-out preventor system of such a subsea well must be capable of sealing off the annular space surrounding either the smaller or the larger drill pipe which may be used.

Testing of the blow-out preventor systems has typically been conducted through the use of a length of drill pipe of the diameter to be tested, with a test plug connected to the bottom of that drill pipe. The drill pipe and test plug are run into the well, and the blow-out preventor system is tested for that particular drill pipe size.

If it is desired to test the blow-out preventor against a second size of drill pipe, a second similar testing string is made up. The first string of pipe must be retrieved from the well, then the second testing string is run into the well.

This tripping of the test string out of the well between the tests on the two different sizes of drill pipe involves substantial time and expense on a subsea well, where as mentioned the wellhead may be located several thousand feet below the drilling platform.

SUMMARY OF THE PRESENT INVENTION

The present invention provides an apparatus for testing a blow-out preventor system on two different sizes of drill pipe without tripping the testing string out of the well between the two tests.

The testing apparatus includes a first elongated cylindrical testing mandrel having an outside diameter substantially equal to an outside diameter of the smaller size drill pipe used in the well. The apparatus further includes a second elongated cylindrical testing mandrel having an outside diameter substantially equal to an outside diameter of the larger diameter drill pipe which is utilized in the well.

The first testing mandrel is telescopingly received within the second testing mandrel.

A releasable locking means is provided for releasably locking the testing mandrels in a telescopingly extended position whereby the blow-out preventor system can be tested against the first testing mandrel, and for releasing the testing mandrels from said extended position so that they can move to a telescopingly collapsed position whereby the blow-out preventor system can also be tested against the second testing mandrel without tripping the testing apparatus out of the well between the two tests.

A second locking means is provided for locking the testing mandrels together in the retracted position prior to the second test.

Numerous objects, features and advantages of the present invention will be readily apparent to those skilled in the art upon a review of the following disclosure when taken in conjunction with the accompanying drawings.

BRIEF DESCRIPTION OF THE DRAWINGS

In FIG. 4A the upper portion of the inner testing mandrel is shown in phantom lines in its telescopingly collapsed position In FIG. 4B the lower portion of the stop sub is shown in phantom lines in its telescopingly collapsed position.

DETAILED DESCRIPTION OF THE PREFERRED EMBODIMENT

Figure 1:
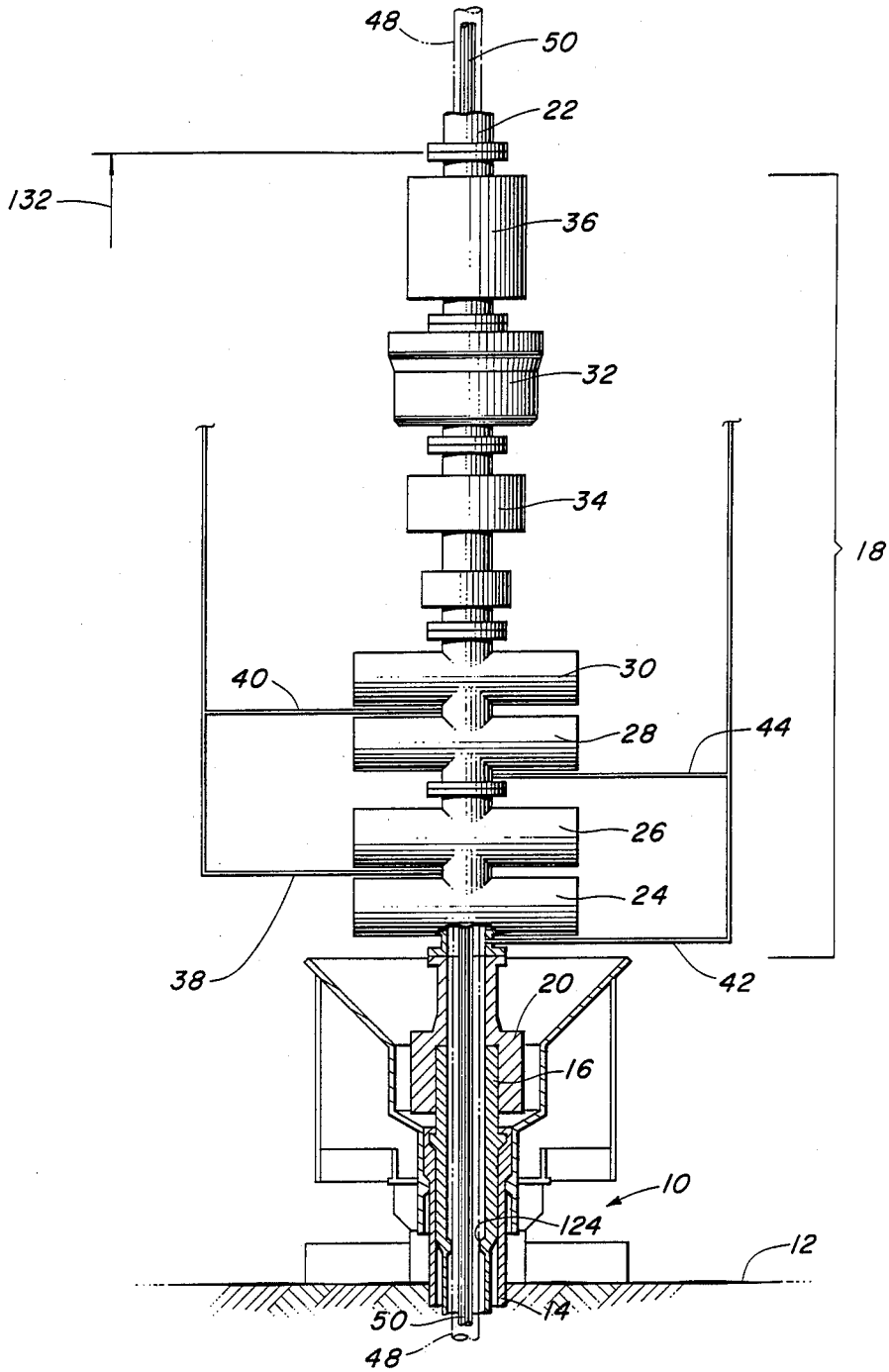
FIG. 1 a somewhat schematic elevation view of a typical subsea well having a blow-out preventor system mounted on top of the wellhead which is located at the ocean floor. A small string of drill pipe is illustrated in solid lines in place within the well. A larger string of drill pipe is illustrated in phantom lines.

FIG. 1 illustrates a typical subsea well and blow-out preventor system with which the present invention can be utilized.

A subsea well 10 is located at the ocean floor 12. The well 10 is constructed from a well casing 14 which is cemented in place in the ocean floor. The well 10 includes a wellhead generally designated as 16 extending a short distance upward above the ocean floor 12.

A blow-out preventor system generally designated by the numeral 18 is connected to wellhead 16 by a hydraulic connector 20. A riser 22 is connected to the upper end of the blow-out preventor system 18 and extends upward to a drilling platform (not shown) located above the surface of the body of water.

A typical blow-out preventor system 18 includes three pipe ram type blow-out preventors 24, 26 and 28 and a blind ram or shear ram type blow-out preventor 30.

Located above the ram type blow-out preventors 24, 26, 28 and 30 is an annular blow-out preventor 32 which is attached by means of a hydraulic connector 34.

A flex joint 36 may be provided for connecting the blowout preventor stack 18 to the riser 22.

Choke lines 38 and 40 extend from the drilling platform down to the blow-out preventor stack 18 at locations immediately below the middle pipe ram 26 and the shear ram 30, respectively. Similarly, kill lines 42 and 44 extend down from the drilling platform to points immediately below the lower pipe ram 24 and the upper pipe ram 28.

As the well 10 is being drilled, it is very typical to utilize more than one size of drill pipe. For example, an initial larger diameter upper portion of the well may be drilled utilizing a larger diameter drill pipe 48 as indicated in phantom lines in FIG. 1. Then, a lower smaller diameter portion of the well may be drilled using a smaller diameter drill pipe 50 such as indicated in solid lines in FIG. 1. The smaller pipe 50 may be suspended from a length of larger pipe 48 when the string actually reaches lower portions of the well. Typical outside diameters of the larger and smaller drill pipes 48 and 50 would be 5.0-inches and 3.5 inches, respectively. This use of different sizes of drill pipe at different stages of drilling of the well 10 is often referred to as using a "tapered" drill string.

It will be appreciated that the blow-out preventor system 18 must be designed to safely close against either the smaller drill pipe 50 or the larger drill pipe 48.

Similarly, when testing the blow-out preventor system 18, its ability to close and seal against either the smaller diameter drill pipe 50 or the larger diameter drill pipe 48 must both be tested.

In a typical blow-out preventor stack 18 designed for use with 5-inch and 3½-inch drill pipe, the lower pipe ram 24 and upper pipe ram 28 would have rams designed to close the annular space surrounding the 5-inch drill pipe 48, and the middle pipe ram 26 would have rams designed to close around the 3½-inch diameter drill pipe 50.

Also, the pipe rams 24, 26 or 28 might be variable bore rams. A variable bore ram is a blow-out preventor which has rams constructed in a manner that they can sealingly close about any drill pipe within a given diameter range. For example, Cameron Iron Works, Inc., of Houston, Tex., manufactures variable bore rams which can seal upon any pipe within a range from 5½-inch diameter to 3½-inch diameter. When using such rams, a typical arrangement would be for the middle and upper pipe rams 26 and 28 to utilize variable bore rams, and for the lower pipe ram 24 to utilize conventional 5-inch rams.

With either of the arrangements of pipe rams just described, or with other commonly encountered arrangements, the blow-out preventor system 18 can generally be described as a system designed to close upon a smaller first drill pipe or tubular member 50 and a larger second drill pipe or tubular member 48.

Figure 2:
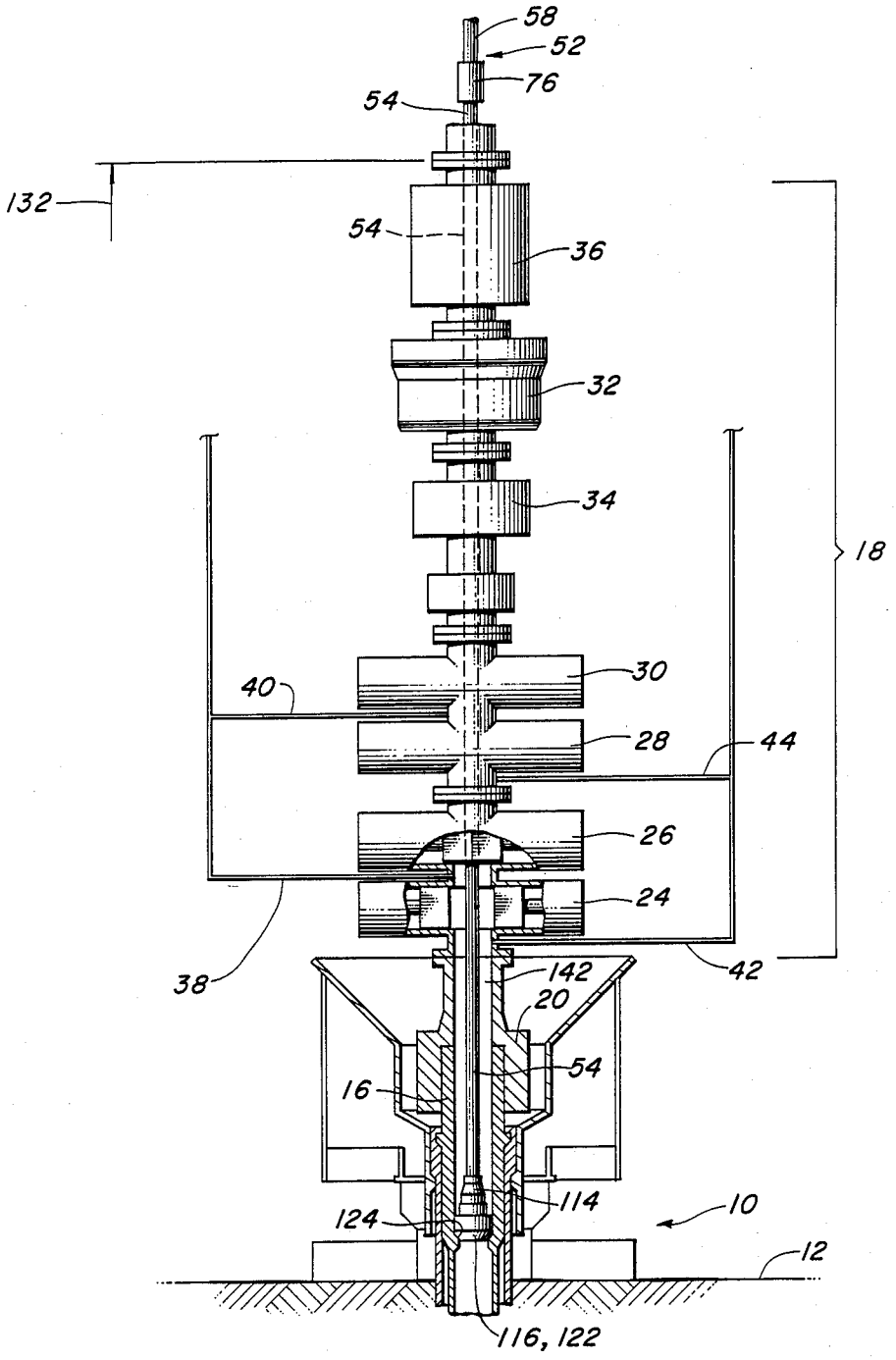
FIG. 2 is an illustration similar to FIG. 1, in which the testing apparatus of the present invention has been lowered into place and a test plug thereof has been set in the wellhead. The testing apparatus is shown ready for testing of the blow-out preventors on the smaller size testing mandrel.
Figure 3:
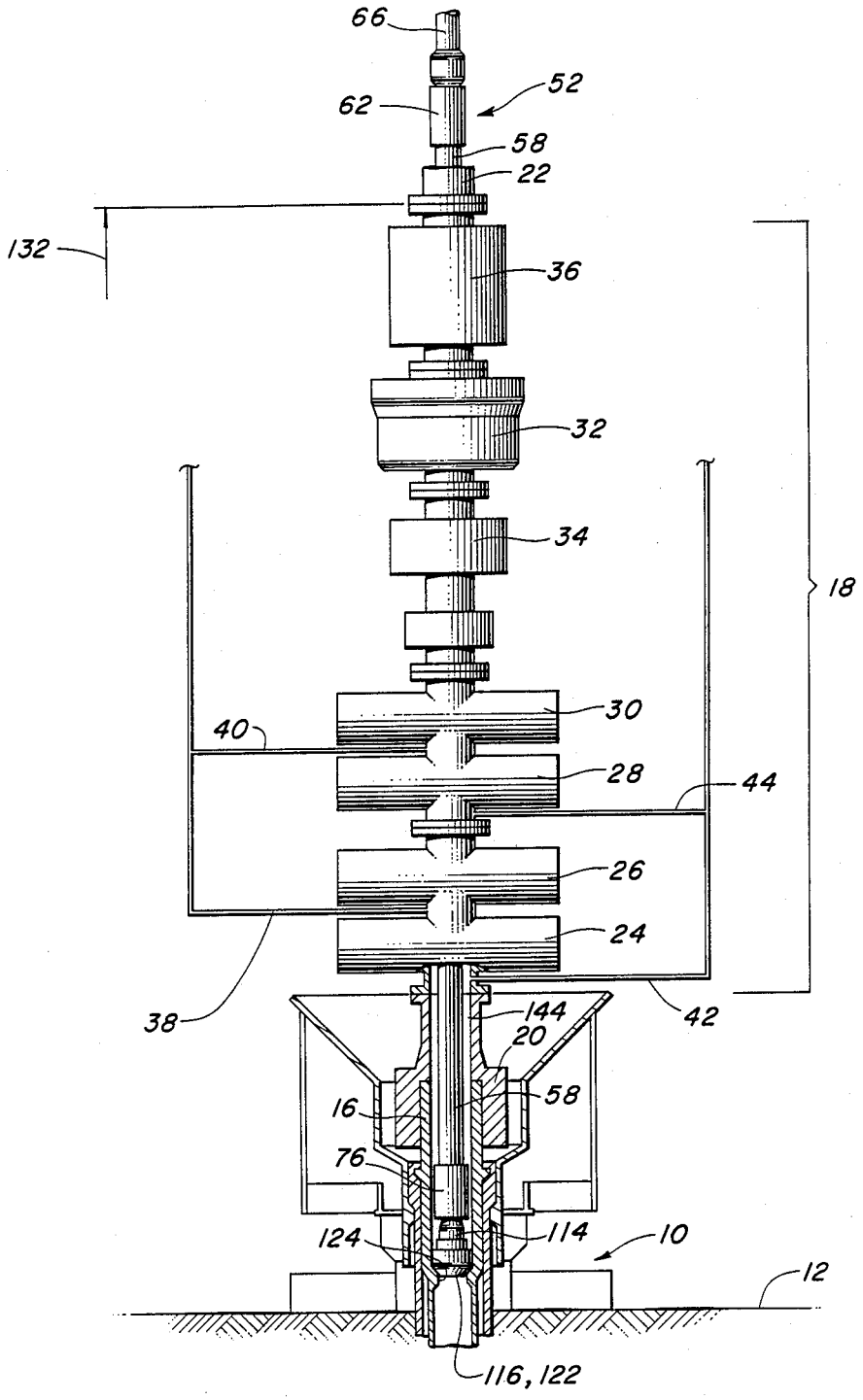
FIG. 3 is another view similar to FIG. 1, which illustrates the testing apparatus after the first and second testing mandrels have been released from each other and have been moved to a telescopingly collapsed position and then again locked together. The testing apparatus as shown in FIG. 3 is ready for testing of the blow-out preventors on the larger testing mandrel.
Figure 4A:
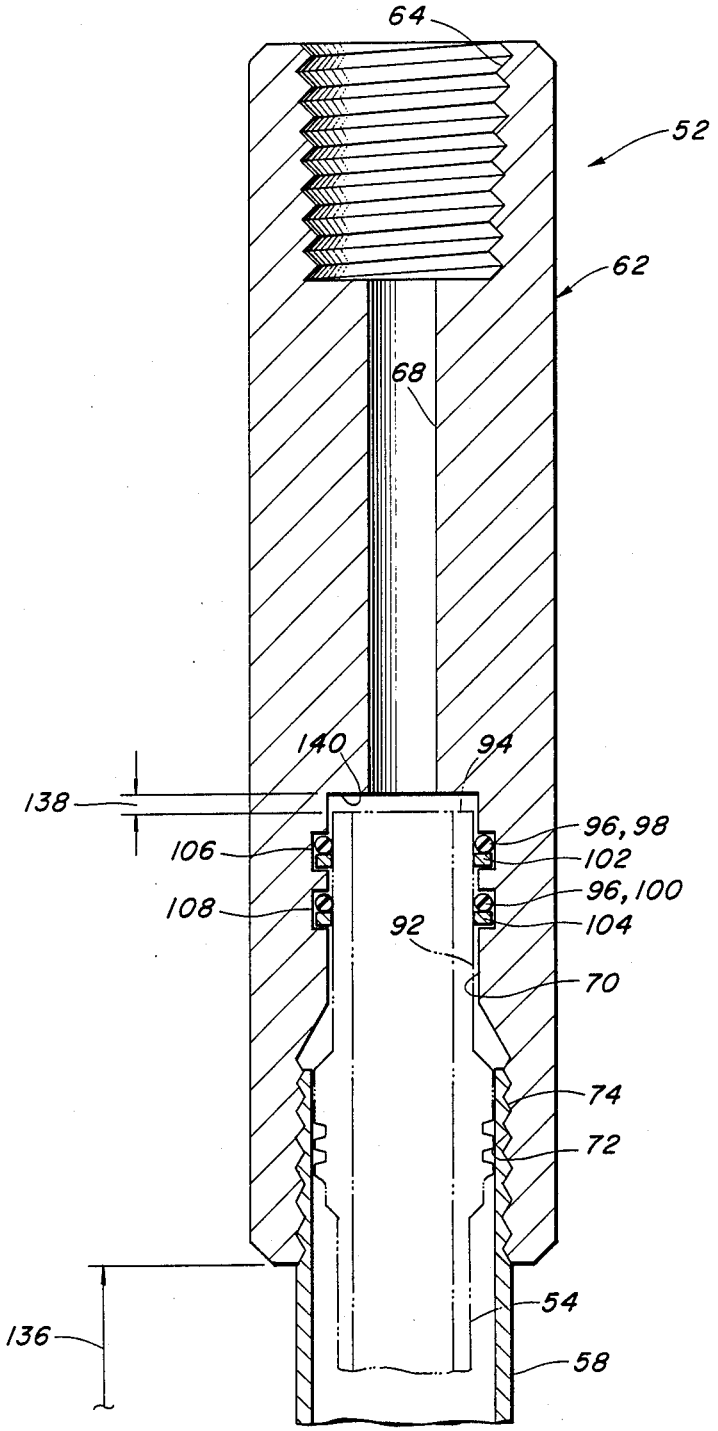
FIGS. 4A–4B comprise an elevation section view of the testing apparatus of the present invention, with the mandrels releasably locked in their extended position.
Figure 4B:
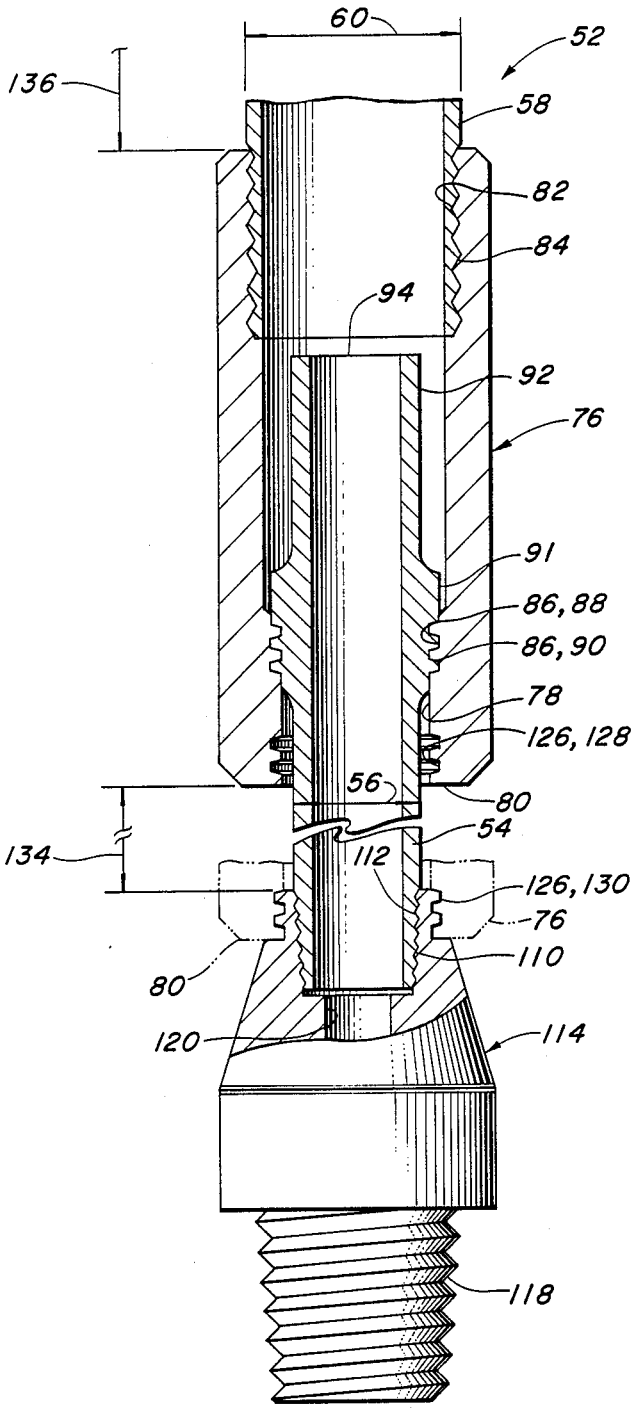

FIGS. 4A–4B taken together comprise an elevation sectioned view of a testing apparatus 52 of the present invention designed for testing of the blow-out preventor system 18. FIG. 2 illustrates the testing apparatus 52 after it has been first lowered into the well 10 and arranged for testing of the blow-out preventor system 18 for its ability to close upon the small size drill pipe 50. FIG. 3 illustrates the testing apparatus 52 after it has been telescopingly collapsed to a position wherein it is ready for testing of the blow-out preventor system 18 for its ability to seal against the larger diameter drill pipe 48.

First, the details of construction of the testing apparatus 52 will be described with reference to FIGS. 4A–4B, and then the method of operation of the testing apparatus 52 will be described with further reference to FIGS. 2 and 3.

Directing attention now to FIGS. 4A–4B, the testing apparatus 52 includes a first elongated cylindrical inner testing mandrel 54 which has an outside diameter 56 substantially equal to the outside diameter of the smaller drill pipe 50.

Testing apparatus 52 also includes a second elongated cylindrical outer testing mandrel 58 having an outside diameter 60 substantially equal to an outside diameter of the larger drill pipe 48.

The testing apparatus 52 further includes a seal sub generally designated by the numeral 62.

The seal sub 62 includes a threaded box connection 64 at its upper end for connecting the testing apparatus 52 to a pipe string 66 (see FIG. 3) with which the testing apparatus 52 is lowered into the well 10.

Seal sub 62 further includes a central bore or passage way 68 extending downward from the threaded box 64. A downwardly open enlarged diameter cylindrical seal bore 70 is located below central bore 68 and is a counterbore thereof. A further enlarged diameter inner threaded lower bore 72 is defined in seal sub 62 below the seal bore 70.

A threaded upper end 74 of outer testing mandrel 58 is engaged with the threaded lower bore 72 of seal sub 62 as seen in FIG. 4A.

Testing apparatus 52 further includes a stop sub 76, having a central passage 78 disposed through a lower end 80 thereof. The stop sub 76 has an enlarged diameter inner threaded upper bore 82 defined therein above the central passage 78.

A threaded lower end 84 of outer testing mandrel 58 is connected to the threaded upper bore 82 of stop sub 76 as seen in FIG. 4B.

The inner testing mandrel 54 is telescopingly received within the outer testing mandrel 58 and extends downward through the central passage 78 of the stop sub 76. In this regard it is noted that when the mandrels 54 and 58 are in a fully extended position as shown in FIG. 4B the inner mandrel 54 may not actually be located inside outer mandrel 58; in that instance the stop sub 76 may be considered to be an extension of outer mandrel 58 and the inner mandrel 54 can still generally be described as being telescopingly received in mandrel 58.

The inner testing mandrel 54 is movable relative to outer testing mandrel 58 between a telescopingly extended position as shown in FIGS. 4A–4B and in FIG. 2, and a telescopingly retracted or collapsed position as shown in phantom lines in FIGS. 4A–4B and in FIG. 3.

The testing apparatus 52 includes a releasable locking means 86 for releasably locking the testing mandrels 54 and 58 in their telescopingly extended position as seen in FIG. 2 whereby the blow-out preventor system 18 can be tested against the first testing mandrel 54, and for releasing the testing mandrels 54 and 58 from said extended position so that they can move to a telescopingly collapsed position as shown in FIG. 3 whereby the blow-out preventor system 18 can also be tested against the outer testing mandrel 58 without tripping the testing apparatus 52 out of the well 10.

The releasable locking means 86 includes a coarse female right-handed thread 88 defined within the stop sub 76, and a coarse complimentary male right-handed thread 90 defined on inner testing mandrel 54.

The male right-handed threads 90 defined on the inner mandrel 54 are located on an intermediate enlarged diameter portion 91 of inner mandrel 54. It is apparent in FIG. 4B that enlarged diameter portion 91 is larger than central passage 78, so that stop sub 76 "stops" the telescoping extension of inner mandrel 54 relative to outer mandrel 58.

The releasable locking means 86 could also be of various alternative designs. For example, a J-slot type connection could be utilized.

Inner testing mandrel 54 has an outer cylindrical sealing surface 92, which may also be referred to as an annular sealing surface 92, defined thereon adjacent an upper end 94 thereof. The annular sealing surface 92 can generally be described as being operably associated with the inner testing mandrel 54 for longitudinal movement therewith relative to the outer testing mandrel 58. In the embodiment illustrated in FIG. 4B, the annular sealing surface 92 is defined on an integral portion of inner testing mandrel 54. That sealing surface could also, however, be machined on a separate component which is attached to the upper end of the inner mandrel 54.

When the inner testing mandrel 54 is in its telescopingly retracted position as shown in phantom lines in FIG. 4A, the annular sealing surface 92 is closely received within the seal bore 70 of seal sub 62.

An annular seal means 96 is provided for sealing between the seal bore 90 and the outer cylindrical or annular sealing surface 92. The seal means 96 preferably includes first and second spaced O-ring seals 98 and 100, respectively. In FIG. 4A each of the O-rings is shown in association with back-up rings such as 102 and 104. The O-rings 98 and 100 are received in annular grooves 106 and 108, respectively, defined in the seal bore 70.

Inner testing mandrel 54 has a threaded lower end portion 110 which is connected to a threaded internal upper bore 112 of a tool joint means 114. The tool joint means 114 provides a means for connecting the testing apparatus 52 to a test plug 116 seen in FIGS. 2 and 3.

The tool joint means 114 has a threaded pin connection 118 at its lower end for connection to the test plug 116.

A central passage 120 extends through the tool joint means 114.

The test plug 116 may be of any one of a number of conventional designs. All that is necessary is that it provide a means for blocking the well 10 below the blow-out preventor system 18, and generally somewhere in the area of the wellhead 16. The test plug 116 illustrated in FIGS. 2 and 3 is of a type such as that manufactured by Cameron Iron Works, Inc., of Houston, Texas, and designated as a combination running and testing tool as shown in the 1982-83 Composite Catalog of Oilfield Equipment and Services, Volume 2, page 1649. This test plug has an annular seal (not shown) defined on its beveled lower outer surface 122 which is landed or seats against an annular upset 124 located inside the bore of wellhead 16.

Other types of test plugs which could be utilized would include cup-type testers and annular casing seals.

The testing apparatus 52 further includes a second locking means 126 for locking the inner and outer testing mandrels 54 and 58 together after they are moved to their telescopingly retracted position as best seen in FIG. 3. The second locking means 126 includes a coarse female right-handed thread 128 defined in the lower portion of stop sub 76, and a complimentary coarse male right-handed thread 130 located on the upper portion of tool joint means 114.

As can best be appreciated in viewing FIG. 4B and FIG. 3, when the right-hand threads of the releasable locking means 86 are disconnected, the outer testing mandrel 58 can then slide downward over the inner testing mandrel 54 until the coarse female right-hand threads 28 located in the lower end of stop sub 76 engage the coarse male right-hand threads 130 on the upper end of tool joint means 114. Then a further right-hand rotation of outer testing mandrel 58 will cause the right-hand threads 128 and 130 to make up thus locking the inner and outer testing mandrels 54 and 58 in their telescopingly retracted position as is illustrated in FIG. 3 and in phantom lines in FIG. 4B.

METHODS OF USING THE TESTING APPARATUS

The general manner in which the testing apparatus 52 is utilized to test the blow-out preventor system 18 will now be described.

First, a testing apparatus like the apparatus 52 must be provided including first and second telescoping mandrels 54 and 58 having smaller and larger outside diameters, respectively, said first and second mandrels 54 and 58 being initially releasably locked in a telescopingly extended position as illustrated in FIG. 2 with the first mandrel 54 extending downward out of the lower end of the second mandrel 58.

Also, a test plug such as test plug 116 must be connected to the lower end of the first testing mandrel 54.

The testing apparatus 52 and test plug 116 are made up on the lower end of a string of drill pipe 66 and lowered down through the riser 22 of well 10 until the test plug 16 is located at a location such as illustrated in FIG. 2 below the blow-out preventor system 18 with the first testing mandrel 54 extending through the blow-out preventor system 18 and with the second testing mandrel 58 located above the blow-out preventor system 18.

A typical blow-out preventor system 18 will extend to a height 132 above the ocean floor 16 in the range of 32 to 35 feet. For such a height, an exemplary testing apparatus 52 would have its inner testing mandrel 54 constructed so as to have a length 134 (see FIG. 4B) between stop sub 76 and tool joint means 114 of approximately forty feet, and to have a length 136 of outer mandrel 58 of similar dimensions. The actual relative dimensions of inner and outer testing mandrels 54 and 58 will be such that when they are in a telescopingly retracted position with the right-hand threads 128 and 130 made up as shown in phantom lines in FIG. 4B, the upper end of inner testing mandrel 54 will be in a position as illustrated in phantom lines in FIG. 4A with the outer cylindrical sealing surface 92 received in seal bore 70 and with there being a clearance 138 between upper end 94 of inner testing mandrel 54 and a downward facing ledge 140 defining the upper end of seal bore 70.

When the testing apparatus 52 is initially lowered into place as shown in FIG. 2, the test plug 116 will be landed or set in the wellhead 16 in a suitable manner depending upon the design of the test plug 116. For a test plug such as the Cameron Iron Works, Inc. combination running and testing tool previously referenced, the test plug 116 is merely landed on the upset 124 and seals thereagainst by downward force exerted on the test plug 116, thus plugging the well 10 at the location of test plug 116.

Just prior to the landing of the test plug 116 in the upset 124 as shown in FIG. 2, it is preferable to flush out the well bore to provide a clean seating surface. This is done by pumping a relatively clean fluid down through the pipe string 66, and through the longitudinal central passageway which extends down through the testing apparatus 52.

With the testing apparatus 52 in the orientation shown in FIG. 2, each of the blow-out preventors 24, 26, 28 and 32 which are constructed to seal against the smaller diameter drill pipe 50 can be tested. For example, if fixed bore rams are used, and the lower and upper pipe rams 24 and 28 are constructed to seal against the larger drill pipe 48, and the middle pipe ram 26 is constructed to seal against the smaller drill pipe 50, the testing would typically be as follows.

First, the middle pipe rams 26 would be closed on the inner testing mandrel 54 as shown to define a first enclosed zone 142 between the middle pipe ram blow-out preventor 26 and the test plug 116.

Then, the zone 142 is pressurized through choke line 38 or kill line 42 to perform a first test of an ability of blow-out preventor 26 of blow-out preventor system 18 to seal against the first testing mandrel 54.

It is noted that there are ways in which the zone 142 can be pressurized other than with the choke and kill lines. For example, a lateral port (not shown) can be placed in tool adapter 114 to communicate bore 120 with zone 142. Then zone 142 can be pressurized by pressurizing the interior of pipe string 66. This lateral port could be plugged if it was desired to pressurize through the choke and kill lines. Similarly a test plug 116 of the type including a weep hole could be utilized to permit pressurizing of zone 142 through pipe string 66.

After the blow-out preventor 26 is tested, then any other blow-out preventors of system 18 capable of sealing against the inner mandrel 54 will be tested. In the example previously mentioned, the next preventor to be tested is the annular preventor 32. The ram type blow-out preventor 26 would have its rams retracted, and then the bag of annular preventor 32 is expanded to seal against the inner testing mandrel 54. Again, a zone is defined between annular preventor 32 and test plug 116, which would be pressurized through any one of the choke lines 38 or 40 or kill lines 42 or 44 to test the annular preventor 32.

After all components of the blow-out preventor system 18 which are intended to seal against the smaller diameter drill pipe 50 are tested, the testing mandrels 54 and 58 will be released from their telescopingly extended position.

This is accomplished by rotating the pipe string 66 and the outer testing mandrel 58 through a right-hand rotation and thereby disengaging the right-handed threaded connection 86 between the testing mandrels. The right-hand rotation causes the female threads 88 to run downward past the male threads 90.

Then, the outer testing mandrel 58 is lowered relative to the inner testing mandrel 54 until the testing mandrels are in their telescopingly collapsed position with the outer testing mandrel 58 extending through the blow-out preventor system 18 as illustrated in FIG. 3.

Then, the inner and outer testing mandrels 54 and 58 are locked together by rotating the outer testing mandrel 58 through a further right-hand rotation and thereby engaging the right-hand threaded connection 126 between the testing mandrels.

Then, the appropriate components of the blow-out preventor system 18 are selectively closed against the outer testing mandrel 58, defining a second enclosed zone 144 between the selected blow-out preventor and the test plug 116.

In the example previously mentioned, the blow-out preventors of system 18 which would be tested against the outer testing mandrel 58 would be the lower and upper ram type preventors 24 and 28, and the annular preventor 32.

As previously mentioned, it is also possible for one or more of the ram type preventors 24, 26 and 28 to include variable bore rams which are capable of sealing against both the smaller diameter drill pipe 50 and the larger diameter drill pipe 48. In the event variable bore rams are utilized, then that particular preventor would be tested against both the inner and outer testing mandrels 54 and 58 in turn.

The locking of the inner and outer testing mandrels 54 and 58 together by second locking means 126 provides an important function when the second enclosed zone 144 is tested.

As is best described with reference to FIGS. 4A–4B, when the right-hand threaded locking connection 126 is made up, the pressure on the exterior of outer mandrel 58 will pass through the threaded connection 126 because it is only a very coarse threaded connection. This pressure will act upward on the outer testing mandrel 58 and seal sub 62 across an annular differential area defined between the annular seal 96, and the outside diameter of outer testing mandrel 58 which is sealingly engaged by the particular blow-out preventor which has been closed against the testing mandrel 58. In a typical testing situation, this upward force will be on the order of 100,000 pounds. If the outer testing mandrel 58 were not locked to the inner testing mandrel 54, this upward force would tend to push the outer testing mandrel 58 upward through the pipe rams which were engaging it.

This is prevented, however, by locking the inner and outer testing mandrels 54 and 58 together at threaded connection 126. There is an even greater downward force being exerted on inner testing mandrel 54, tool joint means 114 and test plug 116, across a typically larger annular differential area defined again between annular seal 96, and the point of sealing engagement of test plug 116 with the upset 124 of wellhead 16. Thus, the upward pressure differential acting on the outer testing mandrel 58 is offset by the downward pressure differential acting on the inner testing mandrel 54, when the inner and outer testing mandrels are locked together.

Also, once it is realized that the coarse locking threads 126 do not themselves prevent fluid pressure from entering the annular space between inner and outer testing mandrels 54 and 58, the importance of the annular seals 96 becomes apparent. If it were not for the annular seals 96 which initiate a seal between the inner and outer testing mandrels as they are telescoped together and which maintain that seal throughout the testing of the blow-out preventor system 18 against the outer testing mandrel 58, the fluid pressures exerted for testing purposes would leak away and prevent a suitable test.

The testing apparatus 52, when utilized in the manner just described, makes it possible to test the blow-out preventor system 18 for its ability to safely seal against both the smaller and larger diameter drill pipes 50 and 52, represented by the inner and outer testing mandrels 54 and 58, without tripping the testing apparatus 52 out of the well 10.

In the context of a subsea well 10, this is economically very advantageous as compared to prior art systems because it saves the rig time necessary to trip one testing apparatus out of the well and replace it with another testing apparatus suitable for testing the second pipe size.

A reasonable estimate of the time saved is two hours per 1,000 foot of water depth. Cost savings would vary with the rig day rate, and the number of tests required during the course of the well. For purposes of example, if the drilling rig is operating in a water depth of 2,000 feet, with a total daily rig cost of $50,000 per day, a cost savings of $8,300 per blow-out preventor test wou be realized. This figure is arrived at by multiplying the four hours of rig time saved, being 1/6 of a day, times the $50,000 day rate.

When it is considered that governmental regulations often require weekly testing of the blow-out preventor systems of a subsea well, it becomes apparent that the apparatus 52 provides a very significant advantage over prior art systems in which two separate testing apparatus must be run into the well to test the blow-out preventor system.

ALTERNATIVE APPARATUS AND METHODS

The apparatus and methods just described wherein the inner and outer mandrels are initially locked in an extended position comprises the preferred embodiment of the invention. It is noted, however, that it is possible to slightly modify the apparatus and methods just described and to initially test the blow-out preventor system 18 against the larger outer mandrel 58, with the second test being against the smaller inner mandrel 54. This would be accomplished as follows.

Referring to FIGS. 4A and 4B, the threaded connections 86 and 126 can be made as a left-hand threaded connections instead of right-handed as previously described.

Then, the testing apparatus 52 can be initially assembled with the threaded connection 126 made up so that the apparatus 52 is locked in its retracted position prior to being run into the well.

The apparatus 52 is then run into the well in a position as illustrated in FIG. 3, and the blow-out preventor system 18 can be tested against the larger outer mandrel 58.

After the first test, right-hand rotation of the drill string 66 and outer mandrel 58 will cause the left-hand threaded connection 126 to be disconnected. Then, by raising the drill string 66 and outer mandrel 58, the testing apparatus 52 is moved to its extended position as illustrated in FIG. 2. A further right-hand rotation of the drill string 66 after engagement of threads 88 and 90 could lock the apparatus 52 in its extended position if desired. Then, the blow-out preventor system 18 could be tested against the smaller inner mandrel 54.

Also, it is noted that in either the originally described preferred embodiment, or in the alternative embodiment just described, it is conceivable depending upon the particular well environment encountered, and the particular size and design of the apparatus 52, to eliminate one or both of the locking connections 86 and 126.

For example, with both threaded connections 86 and 126 eliminated, the apparatus 52 could be run into the well 10 and the test plug 116 set by setting weight down on tubing string 66 thus collapsing the apparatus 52 and applying weight to the test plug 116. Then, the blow-out preventor system 18 could be tested against the outer testing mandrel 58. If the upward differential force acting upon the outer testing mandrel 58 is of a magnitude such that the outer testing mandrel 58 can be safely held in place by the blowout preventor system 18, then it is not absolutely necessary for the inner and outer mandrels to be locked together by threaded connection 126. Subsequently, the outer testing mandrel 58 can be telescoped upward while the test plug 116 and inner mandrel 54 remain in place. Then, the blow-out preventor system 18 can be tested against the inner testing mandrel.

Thus it is apparent that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. Apparatus for testing a blow-out preventor system designed to close upon a smaller first tubular member and a larger second tubular member, said apparatus comprising:

an inner elongated cylindrical testing mandrel having an outside diameter substantially equal to an outside diameter of said first tubular member;

an outer elongated cylindrical testing mandrel having an outside diameter substantially equal to an outside diameter of said second tubular member, said inner testing mandrel being telescopingly received within said outer testing mandrel; and releasable locking means, operably associated with said inner and outer testing mandrels, for releasably locking said testing mandrels in one of a telescopingly extended position, and a telescopingly retracted position, whereby said blow-out preventor system can be tested against one of said testing mandrels, and for releasing said testing mandrels from said one position so that they can move to the other of said telescopingly extended position and said telescopingly retracted position whereby said blow-out preventor system can also be tested against the other of said testing mandrels without tripping said apparatus out of a well in which said blow-out preventor system is installed.

2. Tee apparatus of claim 1, further comprising:

seal means for sealing between said inner and outer testing mandrels when said testing mandrels are in said telescopingly retracted position.

3. The apparatus of claim 2, wherein said seal means comprises:

a seal sub attached to an upper end of said outer testing mandrel for longitudinal movement therewith, said seal sub having a seal bore defined therein;

an outer sealing surface defined on an upper end portion of said inner testing mandrel, said sealing surface being closely received within said seal bore when said testing mandrels are in said telescopingly retracted position; and an annular seal disposed between said seal bore and said sealing surface.

4. The apparatus of claim 3, wherein:

said seal sub is further characterized as having a central bore disposed through an upper end thereof, and said seal bore is a downward facing cylindrical counterbore.

5. The apparatus of claim 1, further comprising:

a second locking means, operably associated with said inner and outer testing mandrels, for locking said inner and outer testing mandrels together in said other of said telescopingly extended position and said telescopingly retracted position.

6. The apparatus of claim 5, further comprising:

test plug means, connected to a lower end of said inner testing mandrel, for plugging a wellhead below said blow-out preventor system;

seal means for sealing between said inner and outer testing mandrels when said testing mandrels are in said telescopingly retracted position; and wherein said inner and outer testing mandrels, said seal means and said test plug are so arranged and constructed that when said blow-out preventor system is tested on said outer testing mandrel an upward pressure differential acting on said outer testing mandrel will be at least partially offset by a downward pressure differential acting on said inner testing mandrel.

7. The apparatus of claim 1, further comprising:

test plug means, connected to a lower end of said inner testing mandrel, for plugging a wellhead below said blow-out preventor system.

8. Apparatus for testing a blow-out preventor system, comprising:

a seal sub having a downwardly open seal bore defined therein;

an outer tubular testing mandrel having an upper end connected to said seal sub;

a stop sub connected to a lower end of said outer testing mandrel, said stop sub having a central passage disposed through a lower end thereof;

an inner testing mandrel telescopingly received within said outer testing mandrel and extending downward through said central passage of said stop sub, said inner testing mandrel being movable relative to said outer testing mandrel between a telescopingly extended position and a telescopingly retracted position; and an annular sealing surface, operably associated with said inner testing mandrel for longitudinal movement therewith relative to said outer testing mandrel, said annular sealing surface being closely received within said seal bore of said seal sub when testing mandrels are in said telescopingly retracted position.

9. The apparatus of claim 8, further comprising:

releasable locking means for initially locking said testing mandrels in one of said extended and retracted positions and for then releasing said mandrels and allowing said mandrels to move to the other of said extended and collapsed positions while said apparatus is in place downhole in a well.

10. The apparatus of claim 9, wherein:

said releasable locking means includes a female thread defined within said stop sub, and a complementary male thread longitudinally movable with said inner testing mandrel.

11. The apparatus of claim 9, further comprising:

a second locking means for locking said inner and outer mandrels together after they are moved to said other of said extended and retracted positions while said apparatus is in place downhole in said well.

12. The apparatus of claim 11, further comprising:

tool joint means attached to a lower end of said inner testing mandrel for connecting said apparatus to a test plug;

wherein said releasable locking means is a threaded connection between said inner testing mandrel and said stop sub for initially locking said mandrels in said extended position; and wherein said second locking means is a threaded connection between said tool joint means and said stop sub for locking said mandrels in said retracted position.

13. The apparatus of claim 8, wherein:

said seal sub has an enlarged diameter inner threaded lower bore defined therein below said seal bore;

said stop sub has an enlarged diameter inner threaded upper bore defined therein above said central passage; and said outer testing mandrel has outer threads at its upper and lower ends which are engaged with said threaded lower bore of said seal sub and said threaded upper bore of said stop sub, respectively.

14. The apparatus of claim 8, wherein:

said seal sub has threaded box means defined in an upper end thereof for connecting said apparatus to a lower end of a pipe string; and said apparatus further includes a tool joint means attached to a lower end of said inner testing mandrel for connecting said apparatus to a test plug.

15. The apparatus of claim 8, further comprising:

annular seal means for sealing between said seal bore and said annular sealing surface.

16. The apparatus of claim 8, wherein:

said seal sub is further characterized in that said seal bore is a cylindrical seal bore; and said annular sealing surface is an outer cylindrical sealing surface defined on an upper end portion of said inner testing mandrel.

17. The apparatus of claim 8, further comprising:

test plug means, connected to a lower end of said inner testing mandrel, for plugging a wellhead below said blow-out preventor system;

seal means for sealing between said inner and outer testing mandrels when said testing mandrels are in said telescopingly retracted position; and wherein said inner and outer testing mandrels, said seal means and said test plug are so arranged and constructed that when said blow-out preventor system is tested on said outer testing mandrel an upward pressure differential acting on said outer testing mandrel will be at least partially offset by a downward pressure differential acting on said inner testing mandrel.

18. A method of testing a blow-out preventor system, said method comprising the steps of:

(a) providing a testing apparatus including inner and outer telescoping testing mandrels, said mandrels being telescopingly movable between a telescopingly extended position, with said inner mandrel extending downward below a lower end of said outer mandrel, and a telescopingly retracted position;

(b) providing a test plug connected to a lower end of said inner testing mandrel;

(c) lowering said testing apparatus and said test plug into a well until said test plug is located at a location below said blow-out preventor system;

(d) plugging said well with said test plug at said location;

(e) closing said blow-out preventor system against a first one of said inner and outer testing mandrels with said mandrels positioned in a first one of said extended and retracted positions and thereby defining a first enclosed zone between said blow-out preventor system and said test plug;

(f) pressurizing said first zone to perform a first test of an ability of said blow-out preventor system to seal against said first one of said inner and outer testing mandrels;

(g) telescopingly moving said testing mandrels to the other of said extended and retracted positions;

(h) closing said blow-out preventor system against said other of said inner and outer testing mandrel to define a second enclosed zone between said blow-out preventor system and said test plug;

(i) pressurizing said second zone to perform a second test of an ability of said blow-out preventor system to seal against said other of said inner and outer testing mandrels; and (k) wherein said testing apparatus and test plug remain in said well throughout steps (e)–(i).

19. The method of claim 18, wherein:

said step (e) is further characterized in that said first one of said extended and retracted positions is said extended position and said blow-out preventor system is closed against said inner testing mandrel; and said method further includes a step, between steps (g) and (i), of locking said inner and outer testing mandrels together in said telescopingly retracted position.

20. The method of claim 19, further comprising a step of:

during step (i), at least partially offsetting an upward pressure differential acting on said outer testing mandrel with a downward pressure differential acting on said inner testing mandrel.

21. The method of claim 18, further comprising steps of:

prior to step (c), releasably locking said testing mandrels in said first one of said extended and retracted positions; and between steps (f) and (g) releasing said testing mandrels from said first one of said extended and retracted positions.

22. The method of claim 21, wherein:

said releasably locking step is further characterized as releasably locking said testing mandrels in said extended position; and said method further includes a step between steps (g) and (i) of locking said testing mandrels together in said retracted position.

23. The method of claim 22, wherein:

said releasing step is further characterized as rotating said outer testing mandrel through a right-hand rotation and thereby disengaging a right-hand threaded connection between said inner and outer testing mandrels; and said locking step between steps (g) and (i) is further characterized as rotating said outer testing mandrel through a right-hand rotation and thereby engaging a right-hand threaded connection between said inner and outer testing mandrels.

24. The method of claim 18, wherein:

said step (e) is further characterized in that said first one of said extended and retracted positions is said extended position; and said method further includes a step during step (g), of initiating a seal between said inner and outer testing mandrels and maintaining said seal during step (i).

* * * * *